US006676494B1

(12) United States Patent
Ching

(10) Patent No.: US 6,676,494 B1
(45) Date of Patent: Jan. 13, 2004

(54) DRILL BIT GRINDER STRUCTURE

(76) Inventor: Chuan-Chien Ching, No. 51, Sec. 1, Taiufu Rd., Tantze Hsiang, Taichung Hsien (TW)

( * ) Notice: Subject to any disclaimer, the term of this patent is extended or adjusted under 35 U.S.C. 154(b) by 0 days.

(21) Appl. No.: 10/458,314

(22) Filed: Jun. 11, 2003

(51) Int. Cl.[7] ..... B24B 7/00
(52) U.S. Cl. ..... 451/231; 451/241; 451/375
(58) Field of Search ..... 451/48, 231, 241, 451/375, 178, 451, 457

(56) References Cited

U.S. PATENT DOCUMENTS 4,658,549 A * 4/1987 Lockwood
5,620,363 A * 4/1997 Hepworth ..... 451/231
6,110,018 A * 8/2000 Hepworth ..... 451/48

* cited by examiner

*Primary Examiner*—Eileen P. Morgan
(74) *Attorney, Agent, or Firm*—Troxell Law Office PLLC

(57) ABSTRACT

A drill bit grinder structure includes: a seat body having a housing, an arched sideboard with a predetermined curvature being disposed on one side of the housing, a slide slot with a predetermined length being formed on the arched sideboard; a fitting member inserted through the slide slot and slidable along the length of the slide slot; and a clamp head fitted through the fitting member. The drill bit grinder structure is characterized by at least a first engaging section disposed on a sidewall of the slide slot and at least a second engaging section disposed in a predetermined position on the circumference of the fitting member corresponding to the first engaging section. The second engaging section can be engaged with the first engaging section to locate the fitting member in a position within the slide slot.

8 Claims, 5 Drawing Sheets

DRILL BIT GRINDER STRUCTURE

BACKGROUND OF THE INVENTION

The present invention is related to a grinding tool, and more particularly to an improved drill bit grinder structure.

U.S. Pat. No. 5,735,732 discloses a grinding apparatus for grinding drill bit. The grinding apparatus includes a sleeve clamp for locating the drill bit in accordance with the shape of the tip of the drill bit. The drill bit is axially clamped and located by the sleeve clamp. Via a specific guide structure, the sleeve clamp is rotated to move the tip of the drill bit up and down relative to the grinding wheel. Accordingly, the tip of the drill bit properly contacts with the circumference of the grinding wheel to complete the grinding operation.

In the above Patent, by means of an angle adjustment mechanism, the sleeve clamp can be slid within a predetermined range in the housing so as to change the contact angle between the tip of the drill bit and the grinding wheel. Therefore, the tip of the drill bit can be ground by different angles.

However, the angle adjustment mechanism is not optimal. The sleeve clamp is fixed by an external bolt. This is inconvenient to a user. In addition, the sleeve clamp is adjusted and located in accordance with some scales serving as reference coordinate. However, when adjusted, the sleeve clamp still needs to be manually accurately moved and aimed at the scales.

SUMMARY OF THE INVENTION

It is therefore a primary object of the present invention to provide an improved drill bit grinder structure in which the contact angle between the tip of the drill bit and the grinding wheel can be quickly and conveniently adjusted.

According to the above object, the drill bit grinder structure includes: a seat body having a housing, an arched sideboard with a predetermined curvature being disposed on one side of the housing, a slide slot with a predetermined length being formed on the arched sideboard; a fitting member inserted through the slide slot and slidable along the length of the slide slot; and a clamp head fitted through the fitting member. The drill bit grinder structure is characterized by at least a first engaging section disposed on a sidewall of the slide slot and at least a second engaging section disposed in a predetermined position on the circumference of the fitting member corresponding to the first engaging section. The second engaging section can be engaged with the first engaging section to locate the fitting member in a position within the slide slot.

The present invention can be best understood through the following description and accompanying drawings wherein:

DETAILED DESCRIPTION OF THE PREFERRED EMBODIMENT

Figure 1:
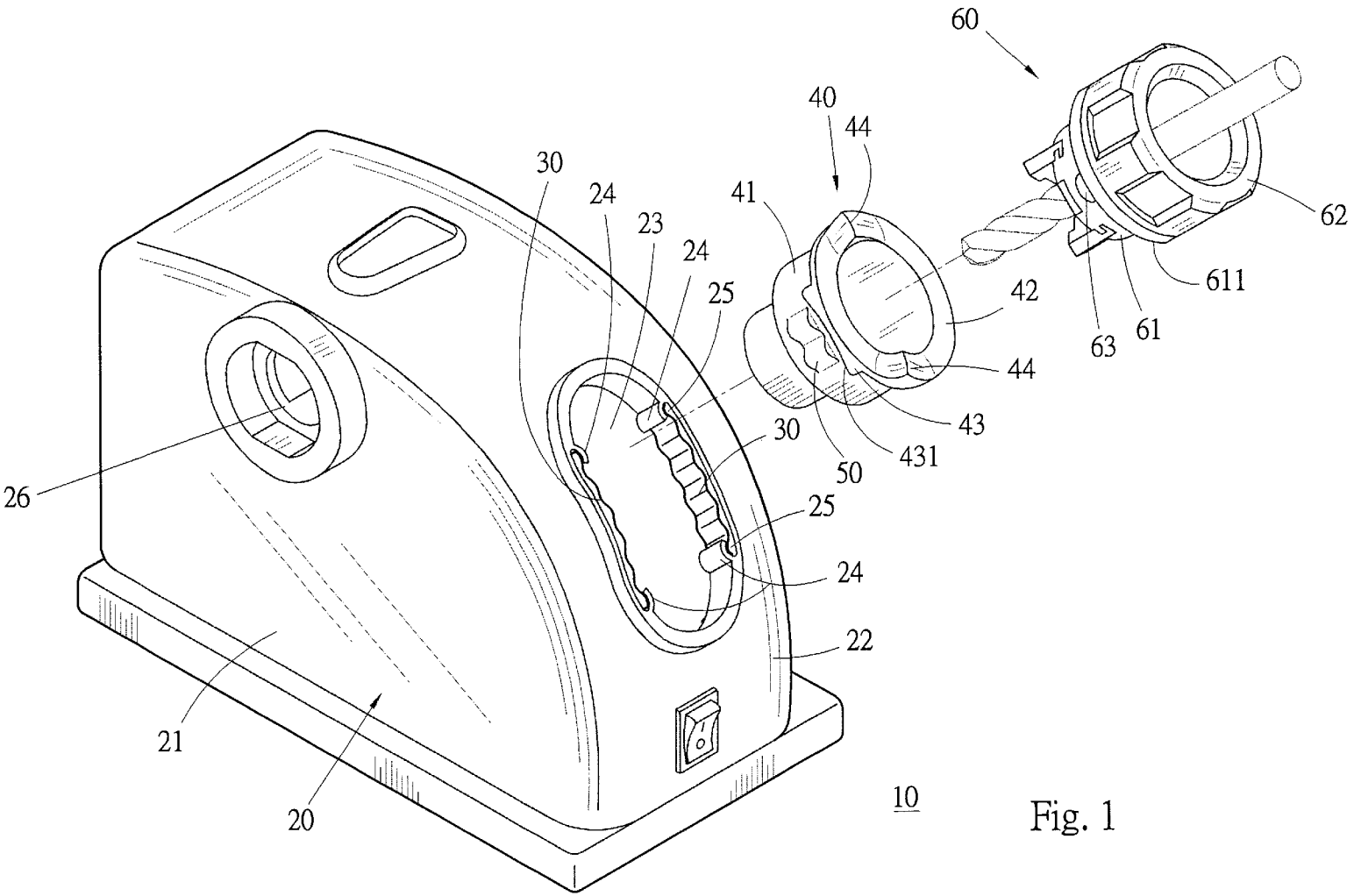
FIG. 1 is a perspective exploded view of preferred embodiment of the present invention.
Figure 2:
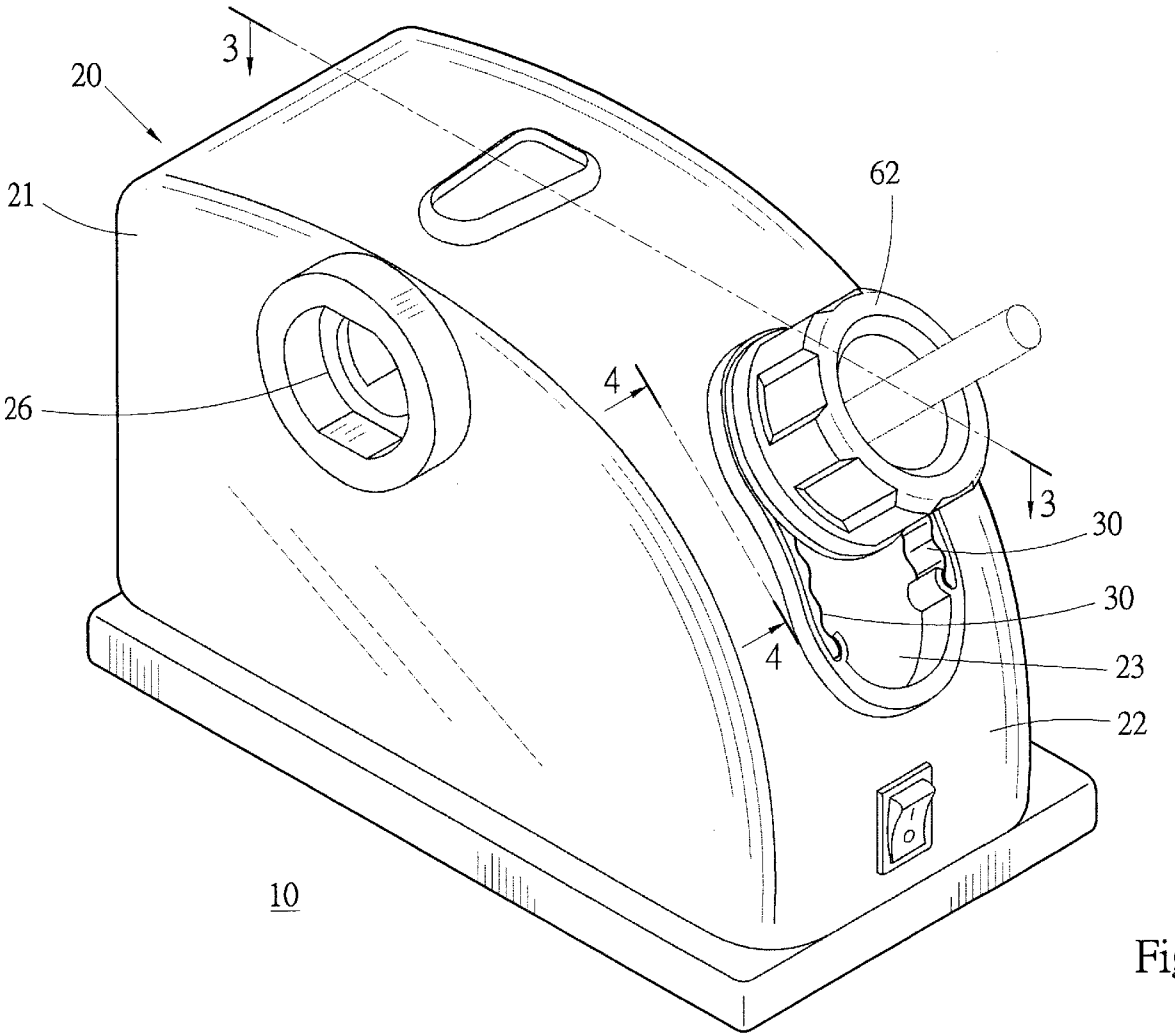
FIG. 2 is perspective assembled view of the preferred embodiment of the present invention.
Figure 3:
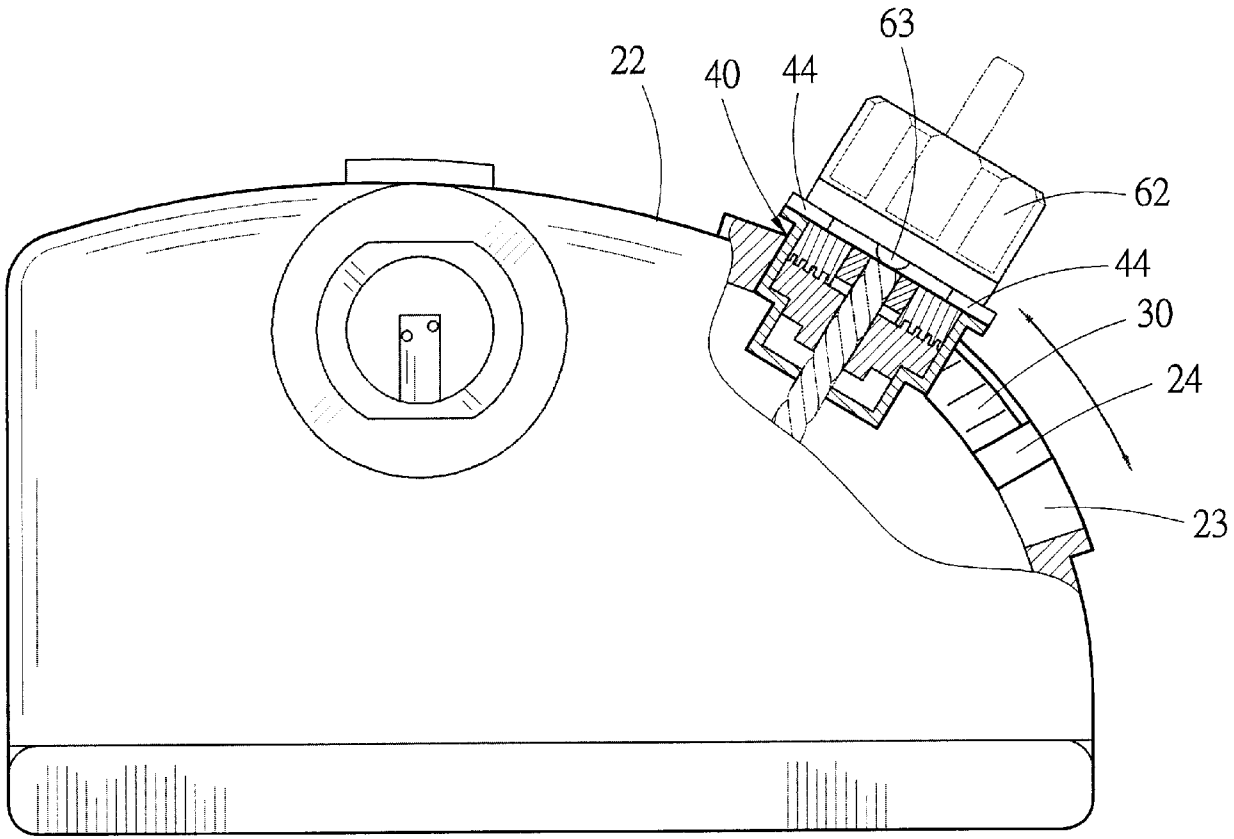
FIG. 3 is a sectional view taken along line 3—3 of FIG. 2.
Figure 4:
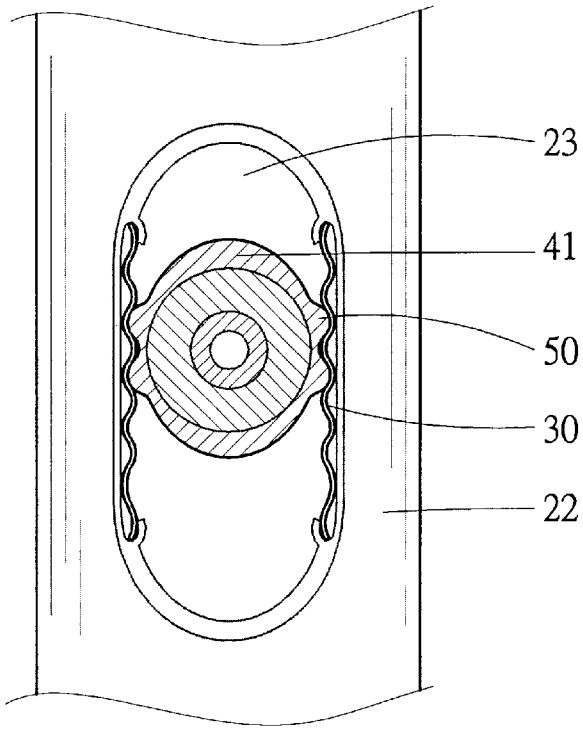
FIG. 4 is a sectional view taken along line 4—4 of FIG. 2.

Please refer to FIGS. 1 to 6. According to a preferred embodiment, the drill bit grinder structure 10 of the present invention includes a seat body 20, two first engaging sections 30, a fitting member 40, two second engaging sections 50 and a clamp head 60.

The seat body 20 has a housing 21 with a certain shape for accommodating therein a power set and a grinding wheel of a conventional grinder. An arched sideboard 22 is disposed on one side of the housing 21. The curvature of the arched sideboard 22 corresponds to the curvature of the grinding wheel received in the housing 21, whereby the sideboard 22 is spaced from the circumference of the grinding wheel by a predetermined distance. A slide slot 23 is formed on the sideboard 22 and extends along the arched face of the sideboard 22 by a certain length. Two pairs of end sections 24 respectively project from two lengthwise sidewalls of the slide slot 23 and are spaced from each other by a certain distance. Each pair of end sections 24 are spaced from the sidewalls of the slide slot 23 by a certain distance to define two insertion channels 25 opposite to each other. An end face of the housing 21 is formed with a through hole 26. A stop plate 27 is disposed in the housing 21 and positioned in an axial position of the through hole 26. Two locating pins 28 are fixedly perpendicularly disposed on a face of the stop plate 27 facing the through hole 26. The locating pins 28 are spaced from each other and correspond to each other.

The first engaging sections 30 are leaf springs with a certain length and thickness. The first engaging sections 30 are waved and extend in the lengthwise direction. Two ends of each first engaging section 30 are inlaid in the insertion channels 25 defined by the corresponding end sections 24. Accordingly, the first engaging sections 30 are respectively parallelly attached to the lengthwise sidewalls of the slide slot 23 with the crests of the first engaging sections 30 opposite to each other.

The fitting member 40 has a tubular main body 41 perpendicularly inserted through the slide slot 23. The fitting member 40 can be slid along the length of the slide slot 23. The bottom end of the fitting member 40 extends into the housing 21. An annular end plate 42 is coaxially fixedly disposed at top end of the main body 41. The bottom face of the end plate 42 faces the arched sideboard 22. Two arched abutting blocks 43 are respectively formed on the bottom face of the end plate 42. The bottom arched faces 431 of the arched abutting blocks 43 abut against the upper face of the arched sideboard 22 on two lengthwise sides of the slide slot 23. The curvature of the bottom arched faces 431 corresponds to the curvature of the arched sideboard 22, whereby when the fitting member 40 slides in the lengthwise direction of the slide slot 23, the fitting member 40 is well supported. Two first guide blocks 44 with a certain shape are formed in two corresponding positions of upper face of the end face 42 and project therefrom.

The two second engaging sections 50 are two projecting blocks respectively formed on the circumference of the main body 41 opposite to each other. The second engaging sect ion 50 has a profile complementary to that of the first engaging section 30 and is adapted to engage with the first engaging section 30. Accordingly, the fitting member 40 can be well located in the slide slot 23.

The clamp head 60 pertains to prior art for clamping rod-shaped article. The clamp head 60 has a cylindrical head section 61 formed with a central hole. The diameter of the central hole is changeable in accordance with the diameter of the rod-shaped article to be clamped. The drill bit can be clamped by the clamp head 60 and coaxially fitted in the hole of the main body 41. A flange 611 of one end of the head section 61 faces the upper face of the end plate 42. A rotary disc 62 is coaxially connected with the end of the head section 61 for an operator to keep the clamp head 60 rotatably fitted in the main body 41. A second guide block 63 projects from the end face of the flange of the head section 61 facing the end plate 42. The end of the second guide block 63 abuts against the upper face of the end plate 42. When the clamp head 60 is rotated within the fitting member 40, the second guide block 63 moves on the upper face of the end plate 42. When the second guide block 63 abuts against the first guide block 44, the clamp head 60 is forcedly axially moved for grinding the drill bit.

According to the above arrangement, the fitting member 40 can be moved within the slide slot 23 so as to change the contact angle contained between the drill bit clamped by the clamp head 60 and the grinding wheel accommodated in the seat body 20. Accordingly, different types of drill bits can be conveniently ground. The first and second engaging sections 30, 50 are engaged to resiliently locate the fitting member 40, whereby after the fitting member 40 is slid to a predetermined specific position, the fitting member 40 is resiliently located in the slide slot 23. Therefore, according to the required grinding angle of a known drill bit, the fitting member 40 can be quickly moved to a corresponding position to facilitate drill bit grinding operation. In contrast, in the aforesaid Patent, no locating measure is provided. Moreover, in the present invention, the fitting member is directly pushed and moved without any other fixing operation. This is simple and meets the actual requirement in use.

Figure 6:
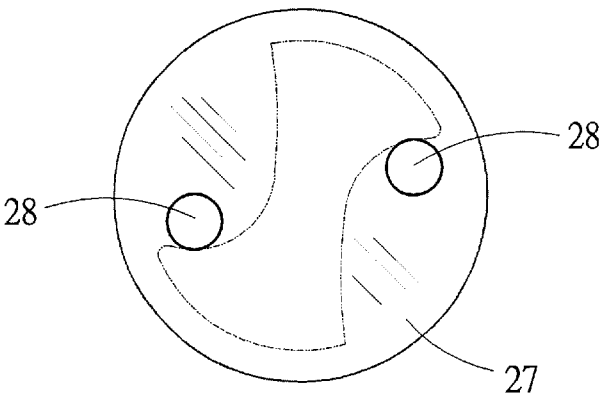
FIG. 6 is a plane view showing that the drill bit is located in a position.
Figure 5:
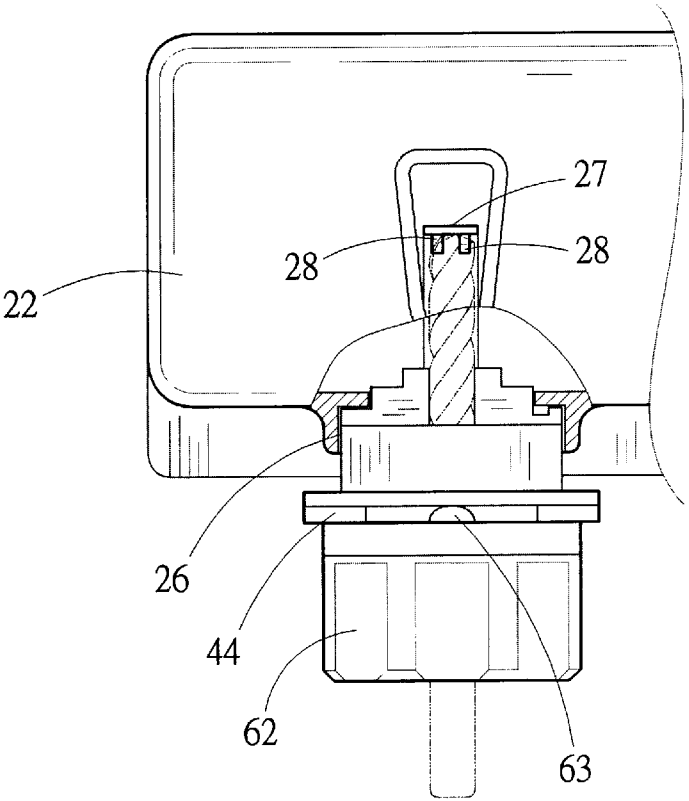
FIG. 5 is a plane view of the present invention, showing that the drill bit is clamped by the clamp head and the length of the drill bit extending out of the clamp head is fixed.

It should be noted that the stop plate 27 is spaced from the through hole 26 by a fixed distance, whereby when the head section 61 of the clamp head 60 is inserted into the through hole 26, the end of the clamped drill bit abuts against the stop plate 27. Therefore, the length of the drill bit extending out of the head section 61 can be controlled (as shown in FIG. 5). Moreover, the two locating pins 28 of the stop plate 27 are inserted into two symmetrical twist grooves of the tip of the drill bit so as to fix the angular state of the drill bit and the head section 61 (as shown in FIG. 6). Accordingly, the clamp head 60 can clamp the drill bit in a specific space pattern to facilitate the drill bit grinding operation.

The above embodiment is only used to illustrate the present invention, not intended to limit the scope thereof. Many modifications of the above embodiment can be made without departing from the spirit of the present invention.

What is claimed is:

1. A drill bit grinder structure comprising:

a seat body having a housing for housing a grinding wheel, an arched sideboard with a predetermined curvature being disposed on one side of the housing, a slide slot with a predetermined length being formed on the arched sideboard;

a fitting member inserted through the slide slot and slidable along the length of the slide slot; and a clamp head for holding a drill bit fitted through the fitting member, said drill bit grinder structure being characterized by:

at least a first engaging section disposed on a sidewall of the slide slot; and at least a second engaging section disposed in a predetermined position on the circumference of the fitting member corresponding to the first engaging section, whereby the second engaging section can be engaged with the first engaging section to locate the fitting member in a position within the slide slot to adjust the position of the drill bit against the grinding wheel.

2. The drill bit grinder structure as claimed in claim 1, wherein the first engaging section is a waved leaf spring with a predetermined length, the first engaging section being disposed on the sidewall of the slide slot, the length of the first engaging section being in parallel to the length of the slide slot.

3. The drill bit grinder structure as claimed in claim 2, wherein the leaf spring is waved and extends in the lengthwise direction.

4. The drill bit grinder structure as claimed in claim 2, wherein the second engaging section is a projecting block formed on a lateral side of the fitting member, the second engaging section having a profile complementary to that of the waved leaf spring.

5. The drill bit grinder structure as claimed in claim 2, wherein two ends of the leaf spring are fixed on the sidewall of the slide slot.

6. The drill bit grinder structure as claimed in claim 5, wherein the seat body has two end sections respectively projecting from the sidewall of the slide slot, two ends of the leaf spring being inserted in the end sections.

7. The drill bit grinder structure as claimed in claim 1, wherein the fitting member has a tubular main body inserted through the slide slot, an annular end plate being disposed at one end of the main body, a face of the end plate facing the arched sideboard, two arched abutting blocks being respectively formed on one face of the end plate for correspondingly abutting against the arched sideboard.

8. The drill bit grinder structure as claimed in claim 7, wherein the abutting blocks abut against the face of the arched sideboard and the curvature of the abutting blocks is equal to the curvature of the arched sideboard.

* * * * *